US006030096A

United States Patent [19]

Lin

[11] Patent Number: 6,030,096

[45] Date of Patent: Feb. 29, 2000

[54] FIGURE LIGHT ASSEMBLY

[75] Inventor: Shwu-Miin Lin, Taipei, Taiwan

[73] Assignee: Shining Blick Enterprises Co., Ltd., Taipei, Taiwan

[21] Appl. No.: 09/022,931

[22] Filed: Feb. 12, 1998

[51] Int. Cl.[7] ..... F21V 21/00

[52] U.S. Cl. ..... 362/249; 362/396

[58] Field of Search ..... 362/249, 252, 362/396, 227, 226

[56] References Cited

U.S. PATENT DOCUMENTS

| | | | |
|---|---|---|---|
| 2,889,451 | 6/1959 | Longo | 362/396 |
| 3,540,687 | 11/1970 | Cuva | 362/249 |
| 4,491,902 | 1/1985 | Cangelosi | 362/396 |
| 5,442,531 | 8/1995 | Lee | 362/249 |
| 5,510,966 | 4/1996 | Konecny | 362/249 |
| 5,788,362 | 8/1998 | Chou | 362/249 |

*Primary Examiner*—Alan Cariaso

*Attorney, Agent, or Firm*—Pro-Techtor International Services

[57] ABSTRACT

A figure light assembly including a figured frame base, and a plurality of lights mounted on the figured frame base, wherein the figured frame base has a plurality of locating blocks raised from a top surface thereof, the locating blocks having a respective through hole; the lamp holders of the lights have a respective clip raised from the periphery and adapted for fastening to the through holes on the locating blocks for permitting the lights to be respectively retained to the locating blocks at a top side.

14 Claims, 4 Drawing Sheets

FIGURE LIGHT ASSEMBLY

BACKGROUND OF THE INVENTION

The present invention relates to a figure light assembly, and more specifically to a light mounting arrangement for a figure light assembly.

During Christmas holidays or days of enjoyment, a variety of figure light assemblies may be used to decorate trees, houses, etc. A regular figure light assembly is generally comprised of a figured frame base, and a plurality of lights mounted on the figured frame base. FIG. 1 shows a figure light assembly according to the prior art, in which two upright retainer rods 11;12 are bilaterally raised from a figured frame base 10, and adapted for holding down the lamp holder 17 of a light 16 on the figured frame base 10. The upright retainer rods 11;12 have a respective top end terminating in an inwardly extended hooked portion 13;14. By inserting the lamp holder 17 through the gap 15 between the hooked portions 13;14 of the upright retainer rods 11;12, the light 16 is secured to the figured frame base 10 by the upright retainer rods 11;12. When the light 16 is installed in the figured frame base 10, the upright retainer rods 11;12 stop the light 16 from moving sideways in A-B direction, however, the upright retainer rods 11;12 cannot positively stop the light 16 from an axial movement in C-D direction.

SUMMARY OF THE INVENTION

The present invention eliminates the aforesaid problem. According to one aspect of the present invention, the figured frame base has a plurality of locating blocks raised from a top surface thereof, the locating blocks having a respective through hole; the lamp holders of the lights, which are installed in the figured frame base, have a respective clip raised from the periphery and adapted for fastening to the through holes on the locating blocks for permitting the lights to be respectively retained to the locating blocks at a top side. According to another aspect of the present invention, the figured frame base has a plurality of raised portions respectively disposed in front of the through hole on each locating block for stopping the clip of the lamp holder of each light in the through hole on the respective locating block.

DETAILED DESCRIPTION OF THE PREFERRED EMBODIMENT

Figure 1:
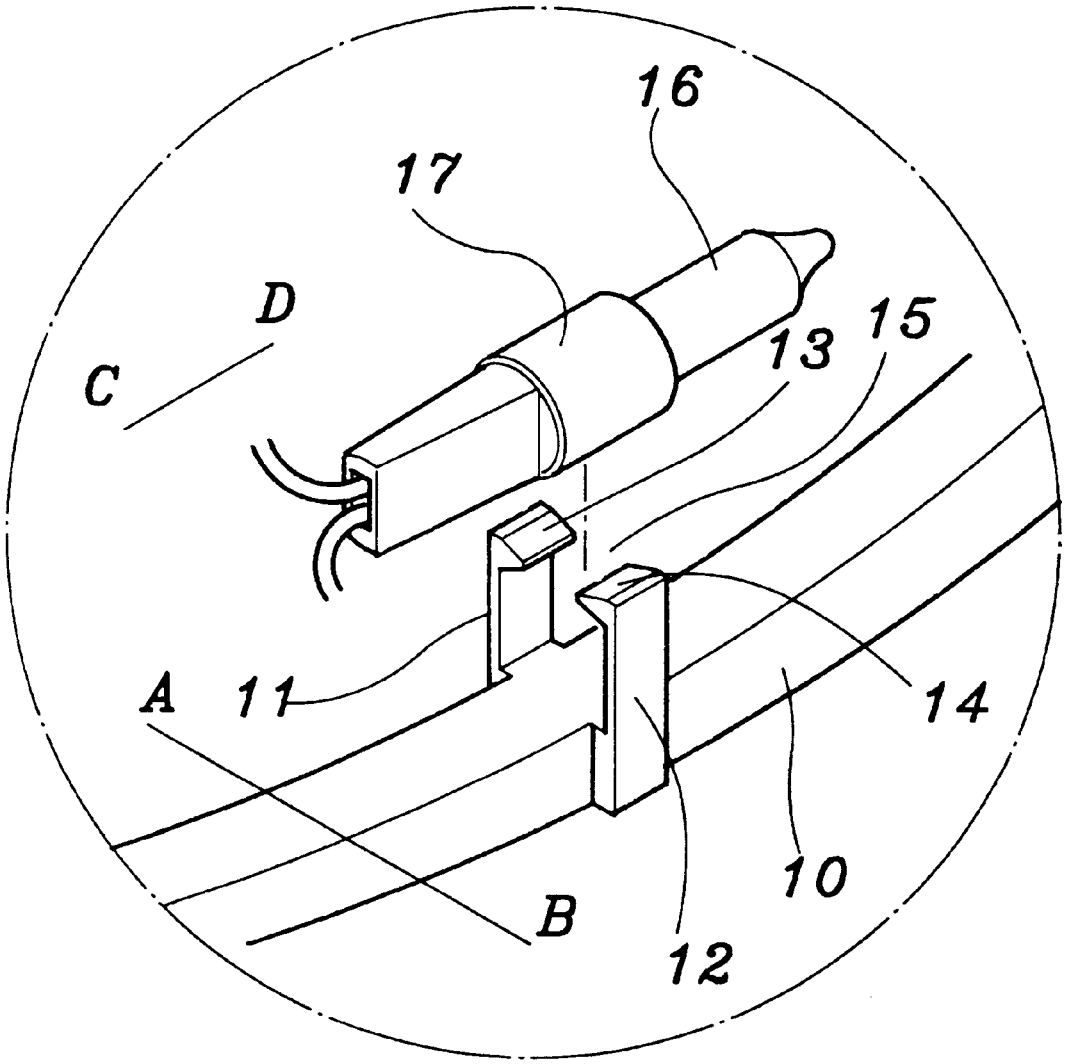
(PRIOR ART) FIG. 1
FIG. 1 is an exploded view of a part of a figure light assembly according to the prior art.
Figure 2:
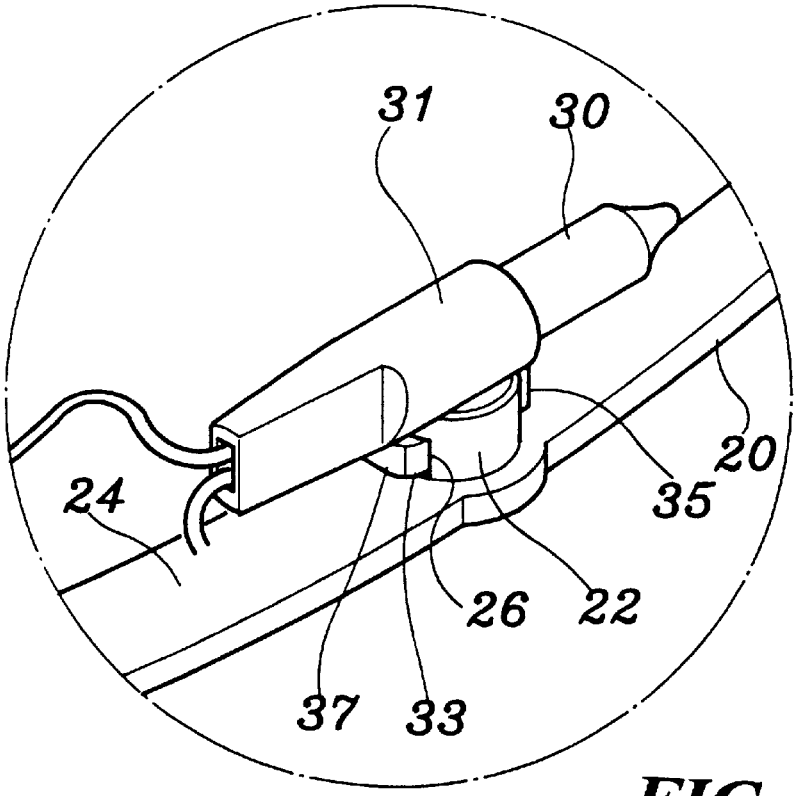
FIG. 2 is a perspective view of a part of a figure light assembly according to the present invention.
Figure 3:
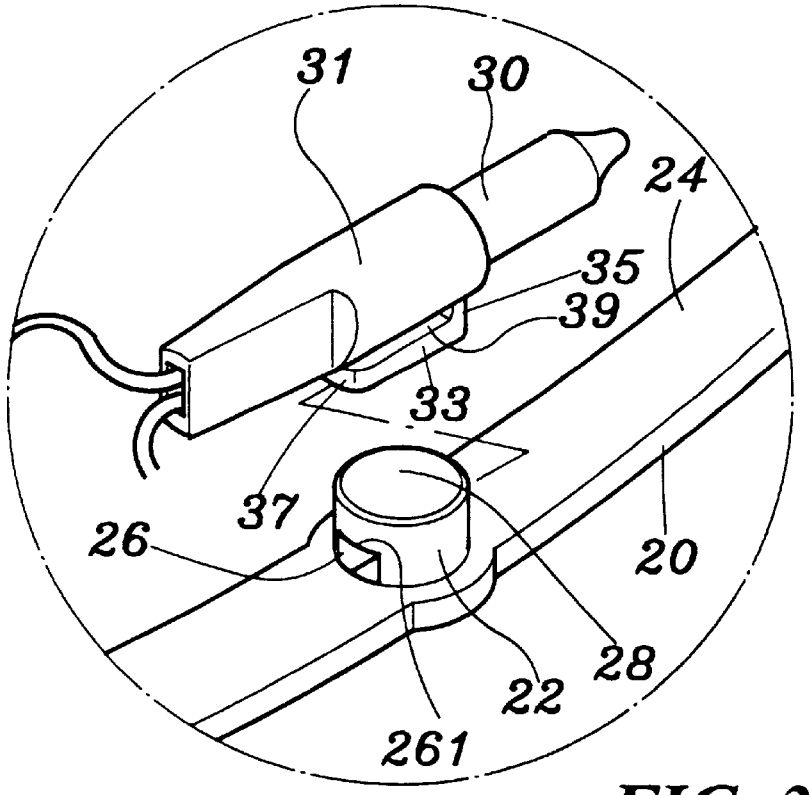
FIG. 3 is an exploded view of FIG. 2.
Figure 4:
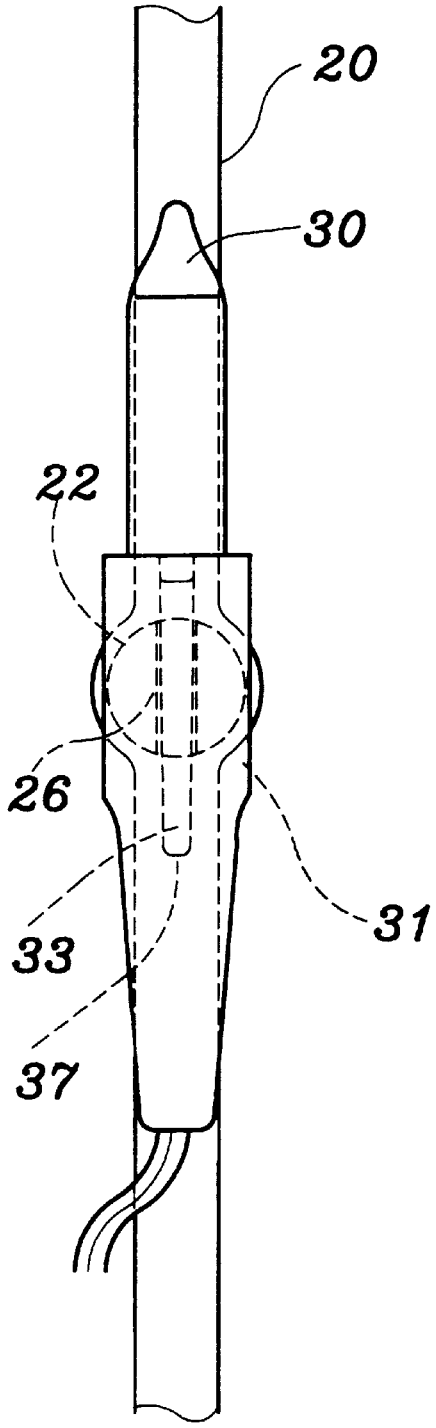
FIG. 4 is a front view of FIG. 2.

Referring to FIGS. 2, 3 and 4, a figure light assembly is comprised of a figured frame base 20, and a plurality of lights 30 respectively mounted on the figured frame base 20. The figured frame base 20 comprises a plurality of integral locating blocks 22 adapted for holding the lights 30. The locating blocks 22 can have any of a variety of shapes, for example, they can have a cylindrical shape. Each locating block 22 comprises a through hole 26 pierced through the connecting area between its bottom side and the surface 24 of the frame base 20. The lamp holder 31 of each light 30 comprises a clip 33. The clip 33 has a fixed end 35 perpendicularly extended from the periphery of the respective lamp holder 31, and a longitudinally extended free end 37 disposed in parallel to the periphery of the lamp holder 31 and spaced from it at a distance 39. The gap (distance) 39 is shorter than the distance between the top side 261 of the through hole 26 and the topmost edge 28 of the locating block 22. Further, the width of the clip 33 is preferably shorter than the transverse width of the through hole 26.

Figure 5:
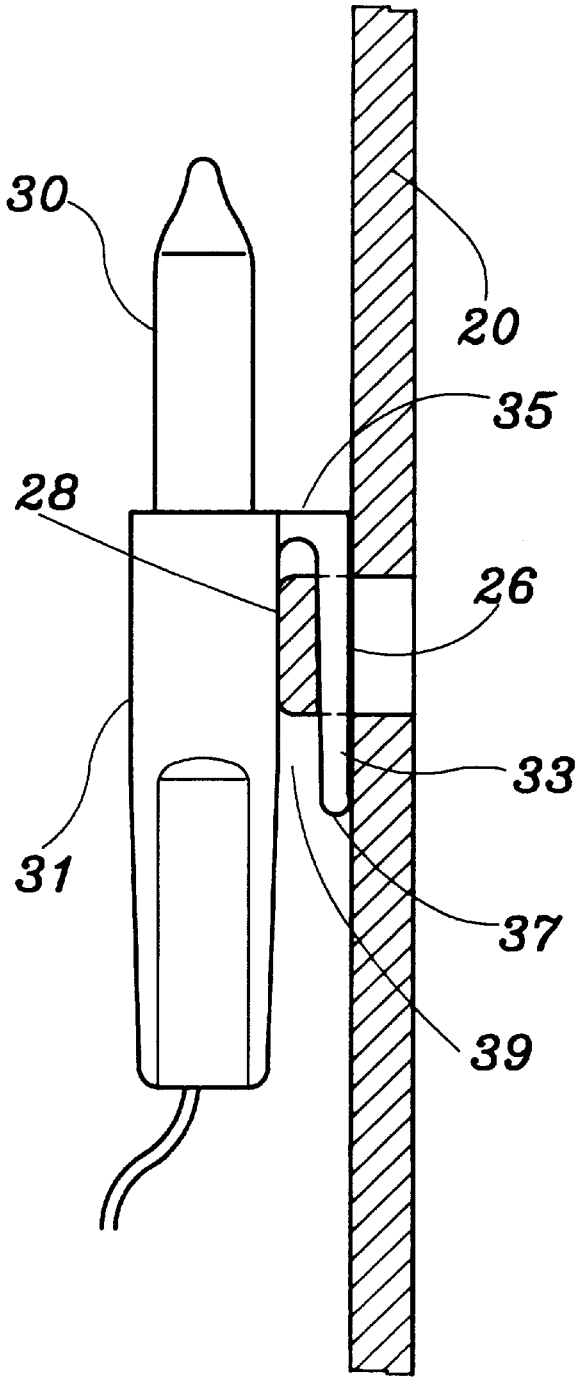
FIG. 5 is side view in section of FIG. 4.

Referring to FIG. 5 and FIGS. 2 and 3 again, the free end 37 of the clip 33 is bent outwards from the periphery of the lamp holder 31 to expand the gap 39, for permitting the free end 37 of the clip 33 to be inserted through the through hole 26 on one locating block 22. After the clip 33 has been fastened to the through hole 26 on one locating block 22, the free end 37 of the clip 33 immediately returns to its former shape, thereby causing the lamp holder 31 to be firmly retained to the topmost edge 28 of the corresponding locating block 22.

Figure 6:
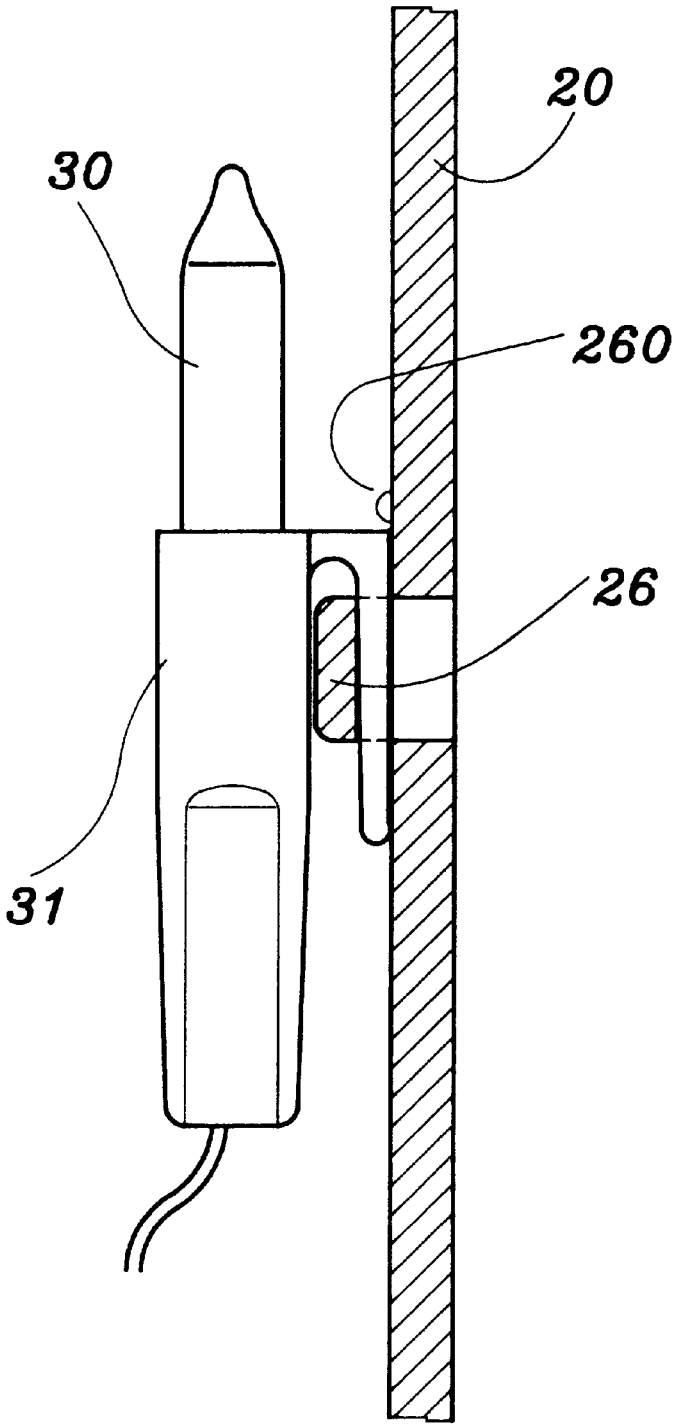
FIG. 6 is a sectional view of an alternate form of the present invention, showing a raised portion raised from the frame base in front of the through hole on the locating block.

Referring to FIG. 6, a raised portion 260 may be provided at the frame base 20 in front of the through hole 26 of each locating block 20 for stopping the installed lamp holder 31 of the corresponding light 30 from forward movement.

It is to be understood that the drawings are designed for purposes of illustration only, and are not intended as a definition of the limits and scope of the invention disclosed.

What the invention claimed is:

1. A figure light assembly comprising a figured frame base, and a plurality of lamp holders mounted on said figured frame base each holding a respective bulb, wherein said figured frame base comprises a plurality of locating blocks raised from a surface of the frame base, said locating blocks each having a respective through hole extending parallel to said surface; and said lamp holders comprising a clip raised from a periphery and configured to extend into the through hole on one of said locating blocks for attaching said lamp holders to the figured frame base.

2. The figure light assembly of claim 1, wherein said locating blocks each have a cylindrical shape with a flat top side.

3. The figure light assembly of claim 2, wherein a width of the through hole in each of said locating blocks is less than a diameter of said locating blocks.

4. The figure light assembly of claim 1, wherein each clip has a fixed end perpendicularly extending from the periphery of the corresponding lamp holder, and a longitudinally extending free end disposed in parallel to and spaced from the periphery of the corresponding lamp holder.

5. The figure light assembly of claim 4, wherein a distance between the free end of the clip and the periphery of the corresponding lamp holder is less than a distance between a topmost edge of the through hole on each of said locating blocks and a topmost edge of the corresponding locating block.

6. The figure light assembly of claim 1, wherein said frame base further comprises a plurality of raised portions, each raised portion respectively disposed in front of the through hole on each of said locating blocks.

7. A figure light assembly comprising a figured frame base, and a plurality of lamp holders mounted on said figured frame base each holding a respective bulb, wherein said figured frame base comprises a plurality of locating blocks raised from a surface thereof, said locating blocks each having a respective through hole; and said lamp holders comprising a clip raised from a periphery of the lamp holder and configured to extend into the through hole on one of said locating blocks for attaching said lamp holders to the figured frame base, wherein each clip has a fixed end perpendicularly extending from the periphery of the associated lamp holder, and a longitudinally extending free end disposed in parallel to and spaced from the periphery of the associated lamp holder.

8. The figure light assembly of claim 7, wherein said locating blocks each have a cylindrical shape with a flat top side.

9. The figure light assembly of claim 8, wherein a width of the through hole in each of said locating blocks is less than a diameter of said locating blocks.

10. The figure light assembly of claim 7, wherein a distance between the free end of the clip and the periphery of the corresponding lamp holder is less than a distance between a topmost edge of the through hole on each of said locating blocks and a topmost edge of the corresponding locating block.

11. The figure light assembly of claim 7, wherein said frame base further comprises a plurality of raised portions, each raised portion respectively disposed in front of the through hole on each of said locating blocks.

12. A figure light assembly comprising a figured frame base, and a plurality of lamp holders mounted on said figured frame base each holding a respective bulb, wherein said figured frame base comprises a plurality of locating blocks raised from a surface thereof, said locating blocks each having a respective through hole; and said lamp holders comprising a clip raised from a periphery of the lamp holder and configured to extend into the through hole on one of said locating blocks for attaching said lamp holders to the figured frame base, wherein said frame base further comprises a plurality of raised portions, each raised portion respectively disposed in front of the through hole on each of said locating blocks.

13. The figure light assembly of claim 12, wherein said locating blocks each have a cylindrical shape with a flat top side.

14. The figure light assembly of claim 13, wherein a width of the through hole in each of said locating blocks is less than a diameter of said locating blocks.

* * * * *